US008664572B2

(12) United States Patent
Bridges

(10) Patent No.: US 8,664,572 B2
(45) **Date of Patent: *Mar. 4, 2014**

(54) NONWOVEN BLANKET WITH A HEATING ELEMENT

(75) Inventor: Cliff Bridges, Greensboro, NC (US)

(73) Assignee: PGI Polymer, Inc., Charlotte, NC (US)

( * ) Notice: Subject to any disclaimer, the term of this patent is extended or adjusted under 35 U.S.C. 154(b) by 2023 days.

This patent is subject to a terminal disclaimer.

(21) Appl. No.: 11/326,359

(22) Filed: Jan. 5, 2006

(65) Prior Publication Data

US 2007/0151029 A1 Jul. 5, 2007

(51) Int. Cl.
*H05B 1/00* (2006.01)
*H05B 3/00* (2006.01)
*H05B 11/00* (2006.01)

(52) U.S. Cl.
USPC ..... 219/212; 219/529; 219/549; 5/421; 607/96

(58) Field of Classification Search
USPC ..... 219/212, 529, 549; 5/421; 607/96
See application file for complete search history.

(56) References Cited

U.S. PATENT DOCUMENTS

| | | | | |
|---|---|---|---|---|
| 3,113,888 | A | 12/1963 | Gold et al. | |
| 3,338,992 | A | 8/1967 | Kinney | |
| 3,485,706 | A | 12/1969 | Evans | |
| 3,493,462 | A | 2/1970 | Bunting, Jr. et al. | |
| 3,730,752 | A | 5/1973 | Garza et al. | |
| 4,077,390 | A | 3/1978 | Stanley et al. | |
| 4,183,975 | A | 1/1980 | Sidders | |
| 4,534,886 | A * | 8/1985 | Kraus et al. | 252/502 |
| 4,536,361 | A | 8/1985 | Torobin | |
| 4,764,665 | A * | 8/1988 | Orban et al. | 219/549 |
| 4,880,953 | A | 11/1989 | Manker | |
| 5,057,268 | A | 10/1991 | Muller | |
| 5,098,764 | A | 3/1992 | Drelich et al. | |
| 5,322,736 | A | 6/1994 | Boyle et al. | |
| 5,447,531 | A | 9/1995 | Wood | |
| 5,475,903 | A | 12/1995 | Collins | |
| 5,679,379 | A | 10/1997 | Fabbricante et al. | |
| 5,834,119 | A | 11/1998 | Roop | |
| 5,925,275 | A * | 7/1999 | Lawson et al. | 219/543 |
| 6,114,017 | A | 9/2000 | Fabbricante et al. | |
| 6,382,526 | B1 | 5/2002 | Reneker et al. | |
| 6,403,935 | B2 * | 6/2002 | Kochman et al. | 219/545 |
| 6,520,425 | B1 | 2/2003 | Reneker | |
| 6,537,309 | B2 * | 3/2003 | Sharma et al. | 607/114 |
| 6,640,801 | B2 | 11/2003 | Sabin et al. | |
| 6,695,992 | B2 | 2/2004 | Reneker | |
| RE38,505 | E | 4/2004 | James et al. | |
| 7,452,835 | B2 * | 11/2008 | Bridges | 442/408 |
| 2005/0211192 | A1 * | 9/2005 | Nilforushan | 119/850 |
| 2006/0151456 | A1 * | 7/2006 | Child et al. | 219/212 |

* cited by examiner

*Primary Examiner* — Henry Yuen
*Assistant Examiner* — Eric Stapleton
(74) *Attorney, Agent, or Firm* — Kilyk & Bowersox, P.L.L.C.; Todd M. Hess

(57) ABSTRACT

A limited use or disposable nonwoven blanket including at least one spunlace layer having an inner surface and outer surface and at least one continuous filament layer having an inner surface and outer surface, wherein the outer surface of the continuous filament layer is metallized. The limited use or disposable nonwoven blanket further includes at least one heating element proximate to the metallized surface of the continuous filament layer.

17 Claims, 3 Drawing Sheets

NONWOVEN BLANKET WITH A HEATING ELEMENT

FIELD OF THE INVENTION

The present invention is generally related to a layered nonwoven fabric construct, and more specifically related to a layered nonwoven blanket incorporating one or more heating elements.

BACKGROUND OF THE INVENTION

Limited use or disposable nonwoven blankets have recently become more accepted due to ease of transport, the minimal amount of space needed for storing the blankets, as well as sanitary reasons. Typically, woven blankets have a substantial weight associated with them. When folded for storage, woven blankets can be bulky and require a great deal of storage space. Woven blankets that are often utilized in the cooler seasons tend to consist of a cotton, polyester, or down fill, which tends to add to the bulk of the blanket, making the blanket more cumbersome and less desirable for transport.

Airlines, shelters, and various institutions have begun utilizing disposable blankets to alleviate health concerns, such as the potential spreading of pathogens. In the past, blankets suitable for repeated use were dry cleaned or laundered and repackaged for reuse. If the blankets were not properly cared for during the cleaning and repackaging process, there was reason to believe the blanket could serve as an intermediary for the spread of infections between users.

Nonwoven fabrics are used in a wide variety of applications where the engineered qualities of the fabrics can be advantageously employed. In general, nonwoven blankets tend to include one or more lofty fibrous batts of carded and cross-lapped staple length fiber that is subsequently bonded by needle-felting or entangling. Typically, the loft associated with the nonwoven blanket correlates with the perceived degree of warmth the blanket could provide; however, as is the case with woven blankets, a lofty disposable blanket requires more storage space and affects the ease of transport.

An unmet need remains for a limited use or disposable nonwoven blanket that provides a desired degree of warmth without being excessively bulky. Further, there remains a need for a limited use or disposable blanket that is lightweight and easily transportable from the house, to the car, to a sporting event, camp site, etc. Further still, there remains a need for a limited use or disposable blanket that requires minimal storage space in a closet or car, and can be easily stored in airline carry-on compartments, personal tote bags, and backpacks.

SUMMARY OF THE INVENTION

The present invention is directed to a limited use or disposable nonwoven blanket including at least a first spunlace layer having an inner surface and an outer surface and at least a second continuous filament layer having an inner surface and outer surface. The outer surface of the continuous filament layer is metallized. The limited use or disposable nonwoven blanket further includes at least one heating element proximate to the metallized surface of the continuous filament layer.

According to the principles of the present invention, the metallized surface of the limited use blanket is typically the surface that comes in direct contact with the user. In addition, the metal coated surface of the limited use blanket readily receives one or more heating elements, such as disposable heat packs. Usually, disposable heat packs are activated by breaking up and combining the chemistries contained within the pack. One or more of the disposable heat packs easily adhere or are otherwise affixed to the metallized surface of the blanket to administer warmth to the user. Most disposable heat packs have a useful duration of about three hours, at which time the packs can be easily removed from the blanket and replaced. Further, the heat packs may be placed at the user's discretion in various locations throughout the metallized surface of the blanket.

In one embodiment of the present invention, the outer spunlace surface of the blanket may be napped to enhance the softness of the blanket. In another embodiment, the outer spunlace surface of the blanket may be embossed or imparted with one or more raised regions, as described in U.S. Pat. No. Re. 38,505, entitled, "Nonwoven Fabrics having Raised Portions", issued on Apr. 20, 2004 in the name of inventors James, et al., hereby incorporated by reference, so as to enhance the aesthetic appeal of the blanket. In yet another embodiment, surfaces of the blanket may be jet dyed to further enhance the aesthetic appeal of the blanket. It is also contemplated that the blanket may include various combinations of the aforementioned enhancements. In addition, the nonwoven blanket preferably has a basis weight in the range of about 50 to about 200 grams per square meter (gsm), and more preferably has a basis weight in the range of about 85 to about 130 gsm.

Optionally, the limited use blanket of the present invention may further include an additional third layer positioned adjacent the metallized outer surface of the continuous filament layer. The third layer may be a nonwoven or woven fabric and preferably has at least one metallized surface. Further, the third layer is bonded to the outer metallized surface of the continuous filament layer so as to form one or more pockets. As defined herein, "pockets" refer to space located between the outer metallized surface of the continuous filament layer and the metallized surface of the third layer after bonding the layers together.

The present invention is also directed to a method of making a limited use or disposable nonwoven fabric, wherein the blanket includes at least a first spunlace layer with an inner surface and outer surface. Formation of a spunlace fabric involves a hydroentanglement process, which is described in U.S. Pat. No. 3,485,706, entitled, "Textile-like Patterned Nonwoven Fabrics and their Production", issued on Dec. 23, 1969 in the name of inventor Evans and U.S. Pat. No. 3,493,462, entitled, "Non-patterned Nonwoven Fabric, issued on Feb. 3, 1970, in the name of inventors Bunting, Jr., et al., both incorporated herein by reference. The spunlace layer may include a fibrous matrix of natural fibers, synthetic fibers, and combinations thereof, wherein the natural fibers may include wood pulp, cotton, rayon, kemp, flax, and combinations thereof. Suitable synthetic fibers include polyolefins, such as polypropylene and polyethylene, polyesters, polyamides, and combinations thereof.

The method of making a limited use blanket further includes at least a second continuous filament layer having an inner surface and an outer surface. Continuous filament fabrics are also referred to as spunbond fabrics. A process of making a spunbond fabric is described in U.S. Pat. No. 3,338,992, entitled, "Process for Forming Nonwoven Filamentary Structures From Fiber-forming Organic Synthetic Polymers", issued on Aug. 29, 1967, in the name of inventor Kinney. The continuous filament layer may also utilize synthetic filaments including polyolefins, polyesters, polyamides, and combinations thereof. Further, the continuous filaments may include homogeneous, bicomponent, and/or multi-component profiles, as well as, performance modifying additives, and the blends thereof.

In addition, the outer surface of the continuous filament layer further includes a metallized coating. The application of a metallized coating or the plating process is well known in the art, particularly in connection with the continuous vacuum metallizing of synthetic polymer films. Suffice to say, the process for the present invention covers the outer surface of the continuous filament web with a metallic layer by evaporating the metal and recondensing it on the web. The process is carried out in a chamber from which the air is evacuated until the residual pressure is approximately one-millionth of normal atmospheric pressure. The clean web is mounted within the vacuum chamber in such a way that it is exposed by line of sight to the metal vapor. The metal vapor is produced by heating the metal to be evaporated to such a temperature that its vapor pressure appreciably exceeds the residual pressures within the chamber. Thus, the metal is converted to a vapor and is transferred in this form to the outer surface of the relatively cool continuous filament web.

In accordance with the present invention, the inner surface of the continuous filament layer and the inner surface of spunlace layer are positioned face-to-face and bonded. The bonding technique may be one of many bonding techniques known to those skilled in the art. In one embodiment, the blanket may be sewn about the outer most edges to permanently secure the layers to one another. In another embodiment, the nonwoven blanket is completely ultrasonically bonded. In yet another embodiment, the layers may be bonded by hydraulically needling the layers together and in still yet another embodiment, the layers may be adhesively bonded.

It is further in the purview of the present invention to include an additional third layer positioned adjacent the outer surface of the metallized continuous filament layer. In one embodiment, the third layer is a nonwoven fabric with at least one metallized surface. Further still, the third layer is bonded to the outer metallized surface of the continuous filament layer such that one or more pockets are formed between the layers. The one or more pockets formed readily receive one or more heating elements. In accordance with this embodiment, the heat is better distributed throughout the blanket, as the metallized surfaces of the blanket layers retains and distributes the heat more effectively.

The limited use or disposable nonwoven blanket of the present invention offers the airline industry, shelters, and various other institutions a solution to alleviate concerns of the potential spreading of pathogens. Further, the blanket includes an added heating feature, which makes it desirable for outdoor recreation applications as well. Further still, the nonwoven blanket of the present invention is easily storable and transportable. Other features and advantages of the present invention will become readily apparent from the following detailed description, the accompanying drawings, and the appended claims.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
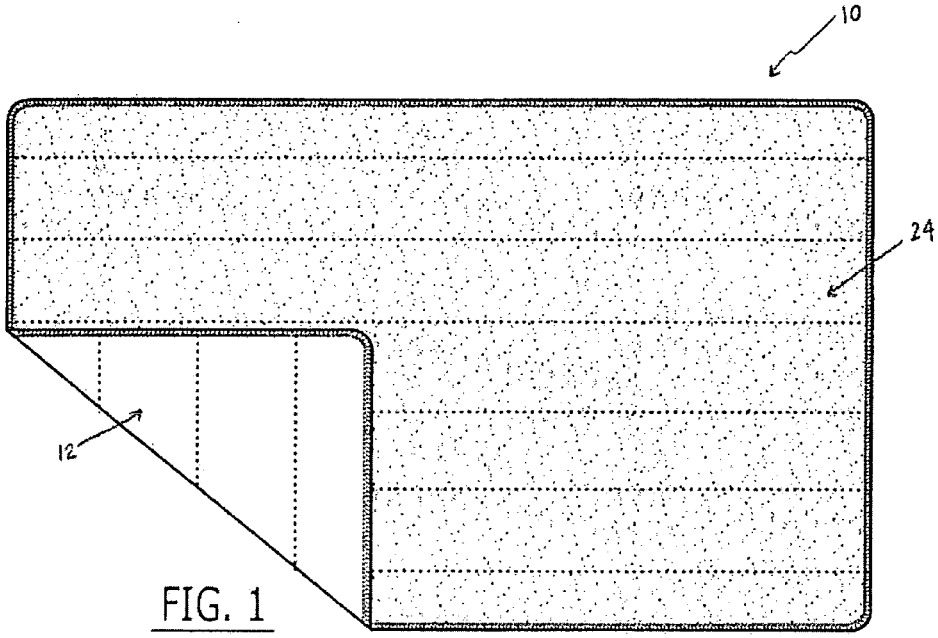
FIG. 1 is a diagrammatic view of a nonwoven blanket, in accordance with an embodiment of the present invention.
Figure 2:
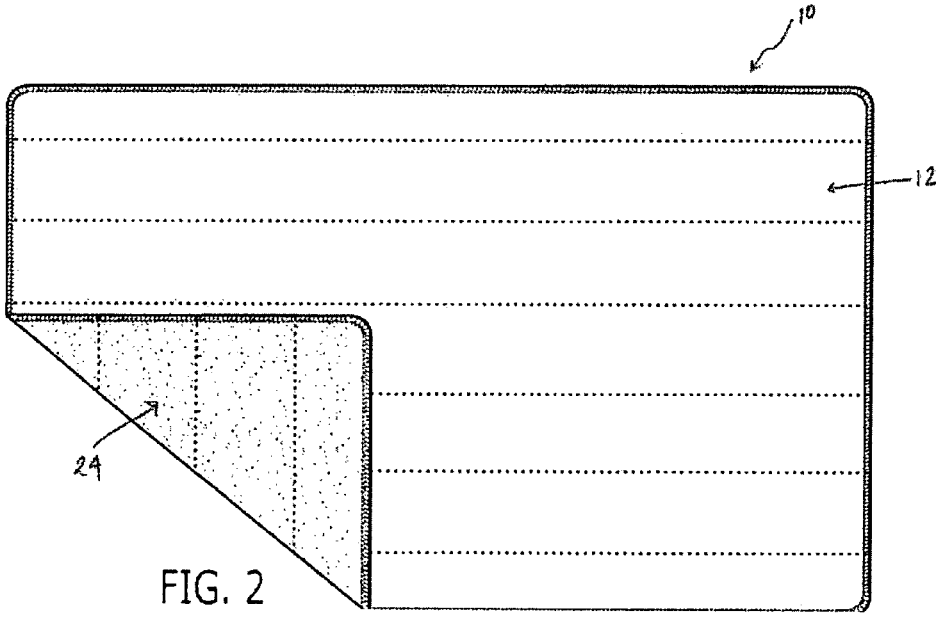
FIG. 2 is a diagrammatic view of a nonwoven blanket, in accordance with an embodiment of the present invention.
Figure 3:
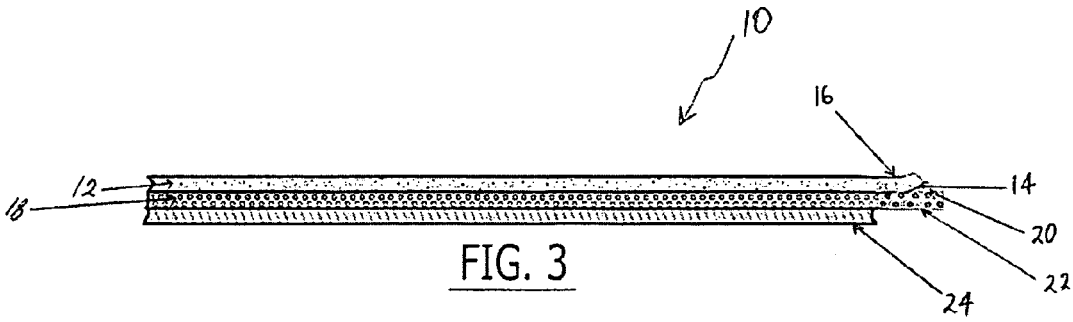
FIG. 3 is a cross-section view of a nonwoven blanket, in accordance with an embodiment of the present invention.

Referring to the drawings, therein FIGS. 1-3 is an illustrative embodiment of the limited use or disposable nonwoven blanket 10 of the present invention, including a spunlace layer 12 having an inner surface 14 and an outer surface 16 and a continuous filament layer 18 having an inner surface 20 and an outer surface 22. The outer surface 22 of the continuous filament layer 18 is coated with a metal material 24.

Figure 4:
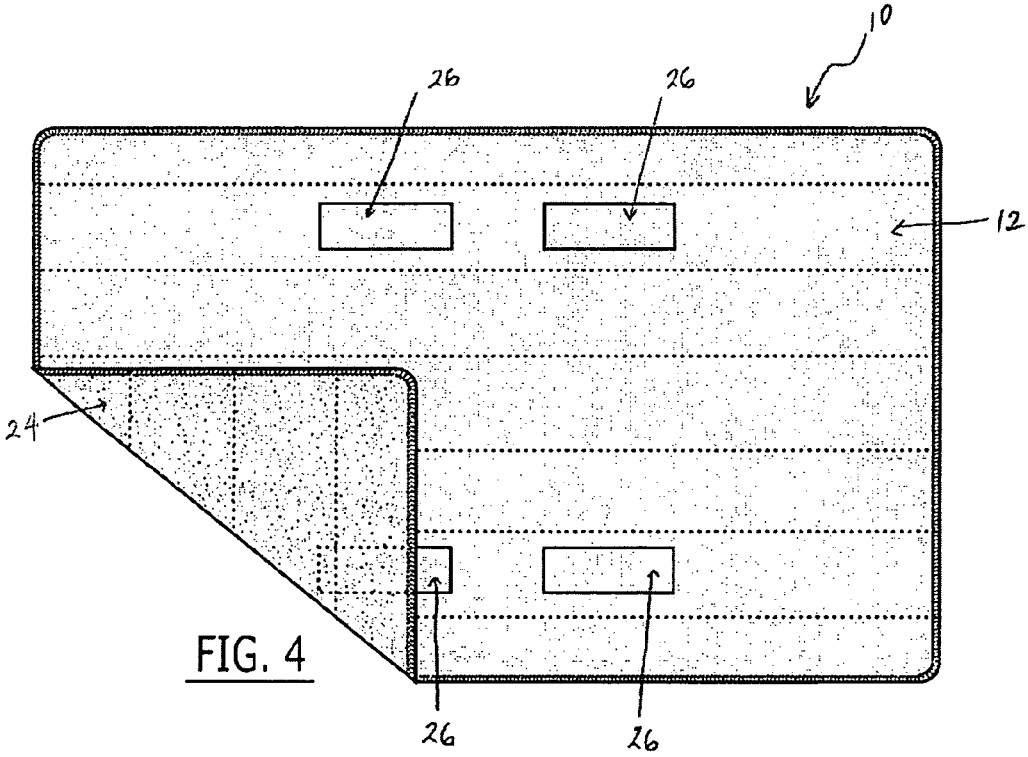
FIG. 4 is a diagrammatic view of a nonwoven blanket, in accordance with an embodiment of the present invention.

FIG. 4 further illustrates the heating elements 26 attached to the metallized surface 24 of the nonwoven blanket 10. The present invention is not limited by the number of heating elements 26 utilized or the position in which the heating elements are located through out the metallized surface 24.

The metal material may include any metal which is suitable for physical vapor deposition or metal sputtering processes may be used to form metallic coatings. Exemplary metals include aluminum, copper, tin, zinc, lead, nickel, iron, gold, silver and the like. Exemplary metallic alloys include copper-based alloys (e.g., bronze, monel, cupro-nickel and aluminum-bronze); aluminum based alloys (e.g., aluminum-silicon, aluminum-iron, and their ternary relatives); titanium based alloys; and iron based alloys. Useful metallic alloys include magnetic materials (e.g., nickel-iron and aluminum-nickel-iron) and corrosion and/or abrasion resistant alloys.

Spunlace Layer

The spunlace layer is of a carded fibrous matrix of staple fiber including natural fiber, synthetic fiber, and combinations thereof. Suitable natural fibers may include wood pulp, cotton, rayon, kemp, flax, and combinations thereof, while suitable synthetic fibers, which may be blended in whole or part, include thermoplastic and thermoset polymers, such as polyolefins, including polyethylene and polypropylene, polyethylene and polypropylene copolymers, polyamides and polyesters. It is further contemplated to include elastomeric fibers, wherein suitable elastomers include without limitation a polyurethane elastomer, a copolyether ester, a polyether block polyamide copolymer, an ethylene vinyl acetate (EVA) elastomer, a styrenic block copolymer, an ether amide block copolymer, an olefinic elastomer, such as polyethylene and polypropylene, as well as other elastomers known to those skilled in the polymer art. The thermoplastic and thermoset polymers may be further selected from homopolymers, copolymers, multi-components, and combinations thereof.

The orientation of fibers with respect to the cross-direction and machine-direction, can significantly impact upon the resultant properties and characteristics of the nonwoven fabric. As will be recognized by those familiar with the art, a nonwoven layer may be formed by a "100% in-line card", which refers to a staple fiber web formed entirely from carded fibers, wherein all of the fibers are principally oriented in the machine direction of the web. In contrast, a fibrous web formed by "all cross-lap" refers to a fibrous web wherein the fibers have been formed by cross-lapping a carded web so that the fibers are oriented at an angle relative to the machine direction of the resultant web. A web can be formed by "one-half crosslap, one-half card", wherein one-half of the basis weight of the web includes a carded fiber web, and one-half of the basis weight includes a cross-lap fiber web. A fibrous web may further be formed with combinations of in-line carded fibers with machine direction orientation, and cross-directional randomized fibers. U.S. Pat. No. 5,475,903, entitled, "Composite Nonwoven Fabric and Method", issued on Dec. 19, 1995, in the name of inventor Collins, illustrates a web drafting apparatus and is hereby incorporated by reference.

Continuous Filament Layer

The thermoplastic polymers typically chosen to form the continuous filament spunbond layer include polyolefins, polyesters, polyamides, and halopolymers, with ethylene-fluorocarbon copolymers, particularly ethylene-chlorotrifluoroethylene (ECTFE). The polyolefins may include polypropylene, polyethylene, as well as copolymers, derivatives, and combinations thereof. Further, the continuous filaments may include homogeneous, bi-component, and/or multi-component profiles, as well as, performance modifying additives, and the blends thereof. Further still, filaments with varying geometric cross-sections may be utilized. Exemplary filaments are disclosed in U.S. Pat. No. 5,057,368, entitled, "Filaments having trilobal or quadrilobal cross-sections", issued on Oct. 15, 1991, in the name of inventors Largman, et al., U.S. Pat. No. 5,322,736, entitled, "Hollow-trilobal cross-section filaments", issued on Jun. 21, 1994, in the name of inventors Boyle, et al., and U.S. Pat. No. 5,834,119, entitled, "Filament cross-sections", issued Nov. 10, 1998, in the name of inventor Roop, which are hereby incorporated by reference.

Depending on the blanket end-use application, it may be desirable to have a blanket that exhibits a high degree of strength. It has been contemplated that utilizing polymeric resins with low melt indexes, such as between about 5 to about 20 MI may enhance the strength of the blanket; however, it is also suitable to utilize polymeric resins with higher melt indexes, about 20 to about 35 MI, depending on the application.

In one embodiment, the nonwoven blanket of the present invention may include extruded and thermally bonded continuous polyethylene filaments. The resultant blanket has excellent drapeability and hand with a preferred basis weight of about 50 to about 200 grams per square meter and a most preferred basis weight of about 85 to about 130 grams per square meter. Prior to extrusion of the filaments, a pigment may be optionally added to the polymeric melt to impart a color into the blanket. Further, subsequent to thermal bonding, the blanket fabric may be subjected to a napping post treatment so as to enhance desired insulative, tactile, and visual properties often sought in a blanket.

Optionally, the continuous filament layer may be further hydroentangled on an imaged forming surface, wherein such surfaces include three-dimensionally surfaced belt, metal drums, wire screens, and three-dimensional image transfer devices. Such surface treatments enhance the aesthetic appearance of the continuous filament layer, as well as improve the overall bulk and hand of the blanket.

Metallized Layer

Subsequent to the formation of the continuous filament layer, a metal material is preferably applied to the continuous filament layer by an evaporative metallizing process. This process deposits a uniform metal coating on the continuous filament surface by evaporating metal wire onto a heated crucible in a low pressure vacuum chamber. Optionally, other chemical or mechanical metallization processes may be utilized, including, but not limited to metal baths, metal sputtering, electron beam metal vapor deposition and the like. Suitable metallizing processes include without limitation, those methods described in U.S. Pat. No. 3,113,888, entitled, "Direct Method for Metallization of Cast-coated Paper", issued Dec. 10, 1963 in the name of inventors Gold, et al., U.S. Pat. No. 3,730,752, entitled, "Method of Metal coating a Fibrous Sheet", issued May 1, 1973 in the name of inventors Garza, et al., and U.S. Pat. No. 4,183,975, entitled, "Vacuum Metallizing Process", issued Jan. 15, 1980 in the name of inventor Sidders, incorporated herein by reference.

As previously mentioned, suitable metals that may be utilized include aluminum, copper, tin, zinc, lead, nickel, iron, gold, silver and the like. Exemplary metallic alloys include copper-based alloys (e.g., bronze, monel, cupro-nickel and aluminum-bronze); aluminum based alloys (aluminum-silicon, aluminum-iron, and their ternary relatives); titanium based alloys; and iron based alloys. Useful metallic alloys include magnetic materials (e.g., nickel-iron and aluminum-nickel-iron) and corrosion and/or abrasion resistant alloys.

In accordance with the principles of the present invention, the metallized layer provides a suitable surface for applying one or more heating elements. Heating elements are preferably limited use heat packs that include an adhesive to affix the heat packs to the metallized surface. A plurality of heat packs may be affixed to the metallized surface of the blanket, wherein the heat packs may be positioned in any desired fashion about the surface. Upon depletion of the usefulness of the heat packs, the one or more heat packs are easily removable from the metallized surface and replacement heat packs may be applied.

Optionally, the limited use blanket of the present invention may include an additional third layer positioned adjacent the outer surface of the metallized continuous filament layer. In one embodiment, the third layer is a nonwoven fabric with at least one metallized surface. Further still, the metallized surface of the third layer is positioned face-to-face and bonded to the outer metallized surface of the continuous filament layer such that one or more pockets are formed between the layers. The one or more pockets formed readily receive one or more heating elements. In accordance with this embodiment, the heat is better distributed throughout the blanket, as the metallized surfaces of the blanket layers retains and distributes the heat more effectively.

Heating Elements

The heating elements suitable for use with the invention include reusable heating elements as taught in U.S. Pat. No. 4,077,390, issued on Mar. 7, 1978 in the name of inventor Stanley, et al., U.S. Pat. No. 4,880,953, issued on Nov. 14, 1989 in the name of inventor Manker, and U.S. Pat. No. 6,537,309, issued on Mar. 25, 2003 in the name of inventor Sharma, et al., as well as moist heating elements as disclosed in U.S. Pat. No. 5,447,531, issued on Sep. 5, 1995 in the name of inventor Wood, and expandable heating elements described in U.S. Pat. No. 6,640,801, issued on Nov. 4, 2003 in the name of inventor Sabin, et al., all of which are hereby incorporated by reference.

In one embodiment, the heating elements utilized are disposable heating elements that are activated by a pressure, typically administered by manually handling the heating element. In addition, the heating elements may be affixed proximate to the metallized surface in more than one fashion, including, but not limited to adhesive, hook and loop fasteners, pinning, snapping, or magnetically affixing the heating elements.

Method of Making

The present invention further includes a method of making a disposable or limited use blanket, wherein the method includes providing at least one spunlace layer having an inner surface and an outer surface. Manufacture of a spunlace layer involves a hydroentangling process. Hydroentangling is described in aforementioned U.S. Pat. No. 3,485,706, previously incorporated by reference.

Figure 5:
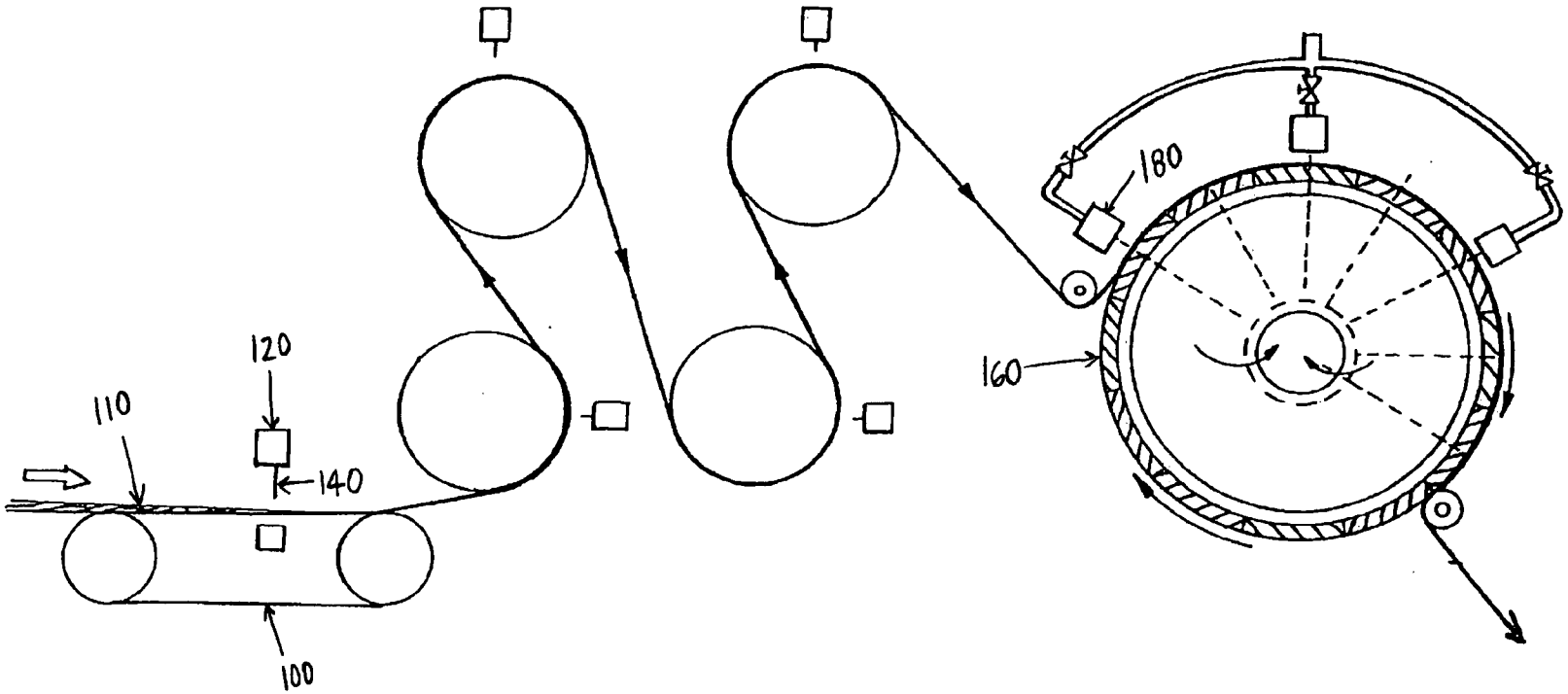
FIG. 5 is a diagrammatic view of an apparatus for practicing a suitable method for hydroentangling the nonwoven fabric of the present invention.

FIG. 5 diagrammatically illustrates an apparatus for practicing a suitable method for hydroentangling the nonwoven fabric. As shown, a precursor web 110 is initially received on a belt 100. Precursor web 110 is subjected to the first of a series of hydroentangling treatments on belt 100. Hydroentanglement of the web 110 being carried by belt 100 is affected by nozzle assembly 120, which is operated to discharge high-pressure columnar jets or streams of liquid 140, typically water. The precursor web 110 is typically subjected to entanglement energy generally on the order of 0.05 to 0.30 horsepower-hour per pound, with the web optionally directed to a hydroentangling apparatus for patterned hydroentanglement of the precursor web.

The entangled web may optionally be moved to an entangling drum 160, which includes a foraminous surface, such as a laser ablated sleeve, perforated metal drum, embossed screens or belts, and the like. Nozzle assembly 180 is configured like nozzle assembly 120, and effects further entanglement of the pre-entangled fibrous web, while imparting one or more raised regions. One suitable foraminous surface (sometimes referred to as an ITD, or image transfer device) is disclosed in U.S. Pat. No. 5,098,764, entitled, "Non-woven fabric and method and apparatus for making the same", issued on May 24, 1992, in the name of inventors Bassett, et al., hereby incorporated by reference. Once entangled and optionally imparted with one or more raised regions, the spunlace layer may be dewatered, dried by one of various methods known in the art, such as by drying cans or through air heat, and wound on a roll.

Subsequent to hydroentanglement, the spunlace layer may be subjected to one or more chemical and/or mechanical post treatments. Chemical post treatments include the application of one or more additives, such as pigments, aromatics, antimicrobials, fire retardants, thermochromics, and the combinations thereof. Mechanical post treatments include without limitation napping, jet dyeing, mechanical compaction as practiced in micrexing or sanforizing (Sanforized is a registered trademark of Cluett, Peabody & Co., Inc), and combinations thereof.

In one embodiment, the hydroentangled spunlace layer is then transferred to a spunbond station, wherein the hydroentangled spunlace layer is unwound and advanced under one or more spinnerettes or dies. Continuous filaments are extruded from a plurality of orifices positioned within the die and collected directly onto the spunlace layer.

A spunbond process involves supplying a molten polymer, which is then extruded under pressure through a large number of orifices in a plate known as a spinneret or die. The resulting continuous filaments are quenched and drawn by any of a number of methods, such as slot draw systems, attenuator guns, or Godet rolls. The continuous filaments are usually collected as a loose web upon a moving foraminous surface, such as a wire mesh conveyor belt. When more than one spinneret is used in line for the purpose of forming a multi-layered fabric, the subsequent web is collected upon the uppermost surface of the previously formed web. The web is usually at least temporarily consolidated, typically by utilizing heat and pressure, such as by thermal point bonding. Using this bonding method, the web or layers of webs are passed between two hot metal rolls, one of which has an embossed pattern to impart and achieve the desired degree of point bonding, usually on the order of 10 to 40 percent of the overall surface area being so bonded.

It is further within the purview of the present invention to include one or more discontinuous filament webs through application of the meltblown process. The melt-blown process is related to the spunbond process for forming a layer of a nonwoven fabric, wherein, a molten polymer is extruded under pressure through orifices in a spinneret or die. High velocity air impinges upon and entrains the filaments as they exit the die. The energy of this step is such that the formed filaments are greatly reduced in diameter and are fractured so that microfibers of finite length are produced. This differs from the spunbond process whereby the continuity of the filaments is preserved.

Nano-filaments may be incorporated as well. The diameters of nano-filaments are generally understood to be less than about 1000 nanometer or one micron. Suitable nano-filament layers can be formed by either direct spinning of nano-filaments or by formation of a multi-component filament, such as islands-in-the-sea, segmented pie, or other configurations, which is divided into nano-filaments. These filaments are often referred to in the art as splittable fiber. U.S. Pat. No. 5,679,379, entitled, "Disposable Extrusion Apparatus with Pressure Balancing Modular Die Units for the Production of Nonwoven Webs", issued Oct. 21, 1997, and U.S. Pat. No. 6,114,017, entitled, "Micro-denier Nonwoven Materials Made Using Modular Die Units", issued Sep. 5, 2000 both in the name of inventors Fabbricante, et al., and incorporated herein by reference, exemplifies direct spinning processes practicable in support of the present invention.

Additional nano-filament technologies suitable for use with the present invention are described in U.S. Pat. No. 4,536,361, entitled, "Method for producing plastic microfilaments", issued Aug. 20, 1985, in the name of inventor Torobin, U.S. Pat. No. 6,382,526, entitled, "Process and apparatus for the production of nanofibers", issued May 7, 2002, in the name of inventors Reneker, et al., U.S. Pat. No. 6,520,425, entitled, "Process and apparatus for the production of nanofibers", issued Feb. 18, 2003, and U.S. Pat. No. 6,695,992, also entitled, "Process and apparatus for the production of nanofibers", issued Feb. 24, 2004, both in the name of inventor Reneker, all of which are hereby incorporated by reference.

It is further contemplated that prior to extrusion, the molten polymer can be compounded with various performance enhancing melt-additives, such as thermal stabilizers, softening agents, antimicrobial agents, fragrances, fire-retarding agents, cross-linking agents, slip additives, and wetting agents, UV, anti-stats, colorants, and nucleating agents. A nucleating agent may be specifically compounded to produce a more stable spinning process, and, at equal process conditions, can produce a further increase in strength. The fabric may be subjected to the application of additional additives as post treatments to fabric formation, such as insect repellents, fragrances, and dyes.

Subsequent to extruding the continuous filament layer directly onto the spunlace layer, the layers are secured or bonded about the outer most perimeters by various suitable methods, including stitch-bonding, ultrasonic bonding, thermal point bonding, or hot roll calendaring. Further, the continuous filament layer of the construct is subjected to a metallizing process, wherein preferably, an aluminum metal coating is evenly applied. The metallized coating of the continuous filament layer readily receives one or more heating elements, such as limited use heat packs.

In an alternate embodiment, at least one preformed spunlace layer and at least one preformed metallized continuous filament layer are positioned in a face-to-face relationship. The spunlace layer and metallized continuous filament layer may be stitch-bonded at least about the outer most edges of the layers. Again, the metallized coating of the continuous filament layer readily receives one or more heating elements, such as limited use heat packs.

It is further in the purview of the present invention to include an additional pre-formed third layer positioned adjacent the outer surface of the metallized continuous filament layer. In one embodiment, the third layer is a nonwoven fabric with at least one metallized surface. Further still, the third layer is bonded to the outer metallized surface of the continuous filament layer such that one or more pockets are formed between the layers. The one or more pockets formed readily receive one or more heating elements. In accordance with this embodiment, the heat is better distributed throughout the blanket, as the metallized surfaces of the blanket layers retains and distributes the heat more effectively.

Blanket Applications

The blanket of the present invention may be disposed of after a single use. Alternately, the blankets may be considered semi-reusable, wherein the blanket may be used a limited number of times before needing to be replaced. Such blankets may be used as recreational blankets, such as camping, picnicking, and sporting event blankets, emergency rescue blankets, institutional blankets, airline blankets, as well as in other applications where blankets of limited use are required or in cases where blankets are used once before being discarded.

Preferably, the nonwoven blanket of the present invention has a basis weight in the range of about 50-200 gsm, and more preferably has a basis weight in the range of about 85-130 gsm. The nonwoven blanket of the present invention is easily foldable, storable, and transportable. The one or more heat packs affixed to the metallized surface makes the blanket ideal for outdoor use, as well as emergency rescue blankets. Further, the disposability of the blanket eliminates the need for a cleaning process, which may potentially leave behind pathogens if not performed according to specifications.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A limited use disposable, recreational blanket, the blanket comprising:

a spunlace layer having an inner surface and an outer surface, wherein said spunlace layer comprises a hydroentangled, carded fibrous matrix of staple fiber;

a nonwoven continuous filament layer having an inner surface and an outer surface, wherein the inner surface of the continuous filament layer is positioned face-to-face with the inner surface of the spunlace layer and the outer surface of the continuous filament layer is metallized wherein the metallized outer surface comprises a metal coating deposited on said outer surface of the continuous filament layer; and at least one disposable heat pack proximate the metallized outer surface of the continuous filament layer, wherein the at least one heat pack is activatable by breaking up and combining chemistries contained within the at least one pack.

2. A limited use blanket as in claim 1, wherein the metal coating of the metallized outer surface of the continuous filament layer comprises aluminum.

3. A limited use blanket as in claim 1, wherein the blanket has a basis weight of about 50-200 grams per square meter.

4. A limited use blanket as in claim 3, wherein the blanket has a basis weight of about 85-130 grams per square meter.

5. A limited use blanket as in claim 1, wherein the spunlace layer is selected from the group consisting of natural fibers, synthetic fibers, and combinations thereof.

6. A limited use blanket as in claim 5, wherein the natural fibers are selected from the group consisting of wood pulp, cotton, rayon, kemp, flax, and combinations thereof.

7. A limited use blanket as in claim 5, wherein the synthetic fibers are selected from the group consisting of polyolefins, polyesters, polyamides, and combinations thereof.

8. A limited use blanket as in claim 1, wherein the continuous filament layer comprises continuous filaments selected from the group consisting of polyolefins, polyesters, polyamides, and combinations thereof.

9. A limited use blanket as in claim 1, wherein the metal coating of the metallized outer surface of the continuous filament layer comprises metal selected from the group consisting of aluminum, copper, tin, zinc, lead, nickel, iron, gold, silver, aluminum alloy, copper alloy, titanium alloy, and iron alloy.

10. A limited use blanket, the blanket comprising:

a spunlace layer having an inner surface and an outer surface, wherein said spunlace layer comprises a hydroentangled, carded fibrous matrix of staple fiber;

a nonwoven continuous filament layer having an inner surface and an outer surface, wherein the inner surface of the continuous filament layer is positioned face-to-face with the inner surface of the spunlace layer and the outer surface of the continuous filament layer is metallized wherein the metallized outer surface comprises a metal coating deposited on said outer surface of the continuous filament layer; and at least one disposable heat pack attached to the metallized outer surface of the continuous filament layer, wherein the at least one heat pack is activatable by breaking up and combining chemistries contained within the at least one pack, and said blanket has drapeability and a basis weight of about 50 to about 200 grams per square meter.

11. A limited use blanket as in claim 10, wherein the metal coating of the metallized outer surface of the continuous filament layer comprises aluminum.

12. A limited use blanket as in claim 10, wherein the spunlace layer is chosen from the group consisting of natural fibers, synthetic fibers, and combinations thereof.

13. A limited use blanket as in claim 12, wherein the spunlace layer comprises synthetic fibers selected from the group consisting of polyolefins, polyesters, polyamides, and combinations thereof.

14. A limited use blanket as in claim 1, wherein the continuous filament layer comprises continuous filaments selected from the group consisting of polyolefins, polyesters, polyamides, and combinations thereof.

15. A limited use blanket as in claim 1, wherein the blanket is foldable.

16. A limited use blanket as in claim 10, wherein the blanket is foldable.

17. A limited use blanket as in claim 10, wherein the at least one heat pack comprises more than one removable heat pack.

* * * * *